US006443609B2

(12) United States Patent
Short

(10) Patent No.: US 6,443,609 B2
(45) Date of Patent: Sep. 3, 2002

(54) FLUID INDUCTOR SYSTEM AND APPARATUS HAVING DEFORMABLE MEMBER FOR CONTROLLING FLUID FLOW

(75) Inventor: David M. R. Short, London (GB)

(73) Assignee: Precision Venturi Ltd., London (GB)

( * ) Notice: Subject to any disclaimer, the term of this patent is extended or adjusted under 35 U.S.C. 154(b) by 0 days.

(21) Appl. No.: 09/756,147

(22) Filed: Jan. 8, 2001

Related U.S. Application Data

(63) Continuation-in-part of application No. 09/176,547, filed on Oct. 21, 1998, now Pat. No. 6,170,978.

(51) Int. Cl.[7] ..... B01F 5/04

(52) U.S. Cl. ..... 366/152.1; 366/163.2; 137/893

(58) Field of Search ..... 366/151.1, 152.1, 366/163.1, 163.2, 167.1, 173.1, 174.1, 175.2, 176.1, 176.2, 181.5, 336, 337, 340; 137/888–895

(56) References Cited

U.S. PATENT DOCUMENTS

| | | | |
|---|---|---|---|
| 907,851 | A | 12/1908 | Munson |
| 948,648 | A | 2/1910 | Hartman |
| 1,065,494 | A | 6/1913 | Andersen et al. |
| 1,283,907 | A | 11/1918 | Rigby |
| 1,454,196 | A | 5/1923 | Trood |
| 1,466,006 | A | 8/1923 | Trood |
| 1,677,265 | A | 7/1928 | Boving |
| 1,839,952 | A | 1/1932 | Daily |
| 2,361,150 | A | 10/1944 | Petroe |
| 2,780,232 | A | 2/1957 | Ney |
| 2,918,933 | A | 12/1959 | Boitnott |
| 2,968,919 | A | 1/1961 | Hughes et al. |
| 3,067,435 | A | 12/1962 | Nash |
| 3,146,195 | A | 8/1964 | Berardi |
| 3,282,227 | A | 11/1966 | Nielsen |
| 3,607,635 | A | 9/1971 | Ripley et al. |
| 3,618,263 | A | 11/1971 | Weijsenburg |
| 4,017,565 | A | 4/1977 | Muller |

(List continued on next page.)

FOREIGN PATENT DOCUMENTS

| | | | |
|---|---|---|---|
| DE | 1030814 | | 5/1958 |
| DE | 1782158 | | 11/1971 |
| EP | 56130213 | | 10/1981 |
| GB | 721292 | | 1/1955 |
| GB | 1101757 | | 1/1968 |
| GB | 1205776 | | 9/1970 |
| GB | 1320746 | * | 6/1973 |
| GB | 1362789 | | 8/1974 |
| GB | 1383776 | | 2/1975 |
| GB | 1517509 | | 7/1978 |
| GB | 1580211 | | 11/1980 |
| GB | 2082928 | A | 3/1982 |
| GB | 2263649 | | 8/1993 |
| WO | 95/21016 | | 8/1995 |

OTHER PUBLICATIONS

Gunther, Ing. R. et al. Oxygeniation with Airmaster, Intermediate Report II, Technocal University Hamburg–Harburg, pp. 2–11, Jul. 23, 1999, Bloens.

*Primary Examiner*—Charles E. Cooley
(74) *Attorney, Agent, or Firm*—Weingram & Associates, P.C.

(57) ABSTRACT

An apparatus for mixing fluids includes a housing which is mounted in line with a conduit carrying a primary fluid. A deformable member is mounted in the housing and an inlet conduit carrying a secondary fluid communicates with the deformable member. An adjustment knob adjusts the width of the deformable member, thereby adjusting the venturi effect created by the deformable member in the flow of primary fluid and adjusting the flow of secondary fluid which flows into the deformable member and is induced out of the deformable member through a plurality of holes to mix with the primary fluid. A system is provided with the fluid inductor apparatus and includes a sensor at the fluid outlet to generate a signal to control the geometric profile of the deformable member to adjust mixing of the fluids.

9 Claims, 7 Drawing Sheets

U.S. PATENT DOCUMENTS

| | | | | |
|---|---|---|---|---|
| 4,023,942 | A | | 5/1977 | Brady et al. |
| 4,051,204 | A | | 9/1977 | Muller et al. |
| 4,087,862 | A | | 5/1978 | Tsien |
| 4,103,351 | A | | 7/1978 | Mamvriisky et al. |
| 4,123,800 | A | | 10/1978 | Mazzei |
| 4,150,693 | A | | 4/1979 | Genevey et al. |
| 4,193,522 | A | | 3/1980 | Edelbach |
| 4,415,275 | A | | 11/1983 | Dietrich |
| 4,552,178 | A | | 11/1985 | Olsson |
| 4,708,829 | A | | 11/1987 | Bylehn et al. |
| 4,812,045 | A | | 3/1989 | McCall |
| 4,917,152 | A | | 4/1990 | Decker |
| 4,972,878 | A | | 11/1990 | Carlin |
| 5,061,406 | A | | 10/1991 | Cheng |
| 5,148,829 | A | | 9/1992 | Deville |
| 5,230,253 | A | | 7/1993 | Blough, Jr. et al. |
| 5,366,288 | A | * | 11/1994 | Dahllof et al. |
| 5,452,955 | A | | 9/1995 | Lundstrom |
| 5,556,200 | A | | 9/1996 | Ekholm et al. |
| 5,573,334 | A | | 11/1996 | Anderson |
| 5,720,313 | A | | 2/1998 | Grobbel |
| 5,902,042 | A | * | 5/1999 | Imaizumi et al. |
| 5,993,054 | A | * | 11/1999 | Tan et al. |
| 6,170,978 | B1 | * | 1/2001 | Short |

* cited by examiner

FLUID INDUCTOR SYSTEM AND APPARATUS HAVING DEFORMABLE MEMBER FOR CONTROLLING FLUID FLOW

CROSS REFERENCE TO RELATED APPLICATION

This application is a continuation-in-part of U.S. Ser. No. 09/176,547 filed Oct. 21, 1998 and issued as U.S. Pat. No. 6,170,978, Jan. 9, 2001.

BACKGROUND OF THE INVENTION

1. Field of the Invention

The present invention relates generally to fluid flow control apparatus and systems and more particularly, to apparatus for introducing a secondary fluid into a primary fluid system and controlling mixing of the primary and secondary fluids.

2. Description of the Related Art

The prior art includes various examples of apparatus for the mixing of the fluid streams, included among which are the following U.S. Patents.

U.S. Pat. No. 907,851 to Munson discloses a flume gate in which a movable gate is mounted in a gate holder which includes cylindrical springs. The flume gate can be moved to adjust the flow through the flume.

U.S. Pat. No. 2,968,919 to Hughes et al discloses a variable area nozzle in which circumferentially spaced vanes are provided in a nozzle throat. The position of the vanes can be adjusted to restrict the flow of fluid through the nozzle in response to changes in pressure upstream from the throat.

U.S. Pat. No. 4,087,862 to Tsein discloses a bladeless mixing device in which streams are tangentially directed into an inlet mixing chamber in which a converging vortex is created which passes through an orifice into an outlet mixing chamber in which a diverging vortex is created. The stream leaves the outlet mixing chamber in a tangential direction for subsequent passage through further stages of the mixing device which include additional inlet and outlet mixing chambers.

U.S. Pat. No. 4,103,351 to Mamyriisky discloses an apparatus for controlling the density of a plugging fluid for oil and gas wells which includes an orifice which is rotatable about its longitudinal axis in the area of mixing a dry cementation material. The orifice produces a flat jet stream which rotates and mixes the dry cementation material.

U.S. Pat. No. 4,123,800 to Mazzei discloses a mixer-injector apparatus in which a throat portion having a portion of decreasing and increasing diameter is disposed between a carrier stream inlet and outlet. A port discharges additive fluid into the throat portion.

U.S. Pat. No. 4,415,275 to Dietrich discloses a swirl mixing device in which a first injector injects a first fluid into a first injection chamber and a second injector injects a second fluid into a second injector chamber. The two fluids have opposite angular momentum and meet near an opening in a collar separating the two chambers.

U.S. Pat. No. 4,552,178 to Olsson discloses a variable fluid flow restricting throttle device in which a pair of members are rotatably connected in a fluid-tight relationship and each of which includes a plurality of fluid flow openings. The members may be rotated to selectively align the fluid flow openings to create varying flow paths of varying diameters.

U.S. Pat. No. 5,061,406 to Cheng discloses an apparatus for in-line dispersion of a gas in a liquid which includes an adjustable conical mixer to control the flow of a gas/liquid mixture to a venturi device. The venturi device is used to accelerate the mixtures to a supersonic velocity with subsequent deceleration to subsonic velocity to produce shock waves in the mixture.

U.S. Pat. No. 5,230,254 to Blough, Jr. et al discloses a fluid mixing device which includes a mixing chamber and four fluid conduits which join the mixing chamber at predetermined angles to introduce fluids into the mixing chamber and create a rapid vortexing action.

U.S. Pat. No. 5,573,334 to Anderson discloses a method for the turbulent mixing of gases in which a first gas flowing from a first orifice in a tubular housing is directed at a second gas flowing from a second orifice. The two orifices are offset so as to produce a swirling action within the tubular housing.

Although the prior art includes various examples of devices intended to introduce a secondary fluid into a stream of primary fluid, there still remains a need for an apparatus which can both introduce the secondary fluid into the stream of primary fluid and control the flow of secondary fluid in a simple and effective manner.

SUMMARY AND OBJECTS OF THE INVENTION

A fluid inductor apparatus includes a hollow housing having inlet and outlet fluid couplings for insertion of the housing in a fluid conduit which carries a fluid designated as the primary fluid. An adjustment knob is rotationally mounted on an upper panel of the housing, the upper panel including an inlet tube for the introduction of a fluid which is designated as the secondary fluid. The inlet tube communicates with a hollow wedge member which is disposed in the hollow housing. The wedge member has a diamond shape of four side panels which are connected by hinges, thereby facilitating adjustment of the angles formed by the side panels.

The adjustment knob includes a plate with a spiral groove. A pin projecting from a motion transmission plate which has a V-shaped slot moves along the spiral groove and moves the motion transmission plate. A pair of oppositely disposed side panels on the wedge member includes guide pins which project through slots in a guide plate and the motion transmission plate. Rotation of the adjustment knob causes the wedge member to expand and contract in width.

A pair of side panels of the wedge member include a plurality of holes and secondary fluid is drawn into at least one wedge member and then drawn through the holes in the side panels and then drawn into the stream of primary fluid. Rotation of this adjustment knob changes the dimensions of the wedge member thereby varying the venturi effect caused by the wedge member and consequently controlling the flow of secondary fluid from the wedge member.

The present invention also includes a method of inducing a liquid into a flowing stream of another liquid by moving a primary liquid through a flow tube and interposing a distribution member in the flow tube for having its geometry varied to produce a low pressure area at a downstream side of the distribution member. A secondary liquid is introduced into the distribution member and drawn through passages of the distribution member toward the downstream section of the member by the low pressure created from the positioning and shaping of the distribution member with respect to the primary fluid flow.

The present invention also includes a system for adjusting and controlling the combining of first and second fluids at the fluid inductor apparatus according to the present invention.

The system includes a sensor downstream of the fluid inductor apparatus for sensing a specific parameter, such as the blend of the fluids combined by the fluid inductor apparatus, and generating a signal to adjust the fluid inductor apparatus to provide a mixture having select parameters.

Another embodiment of the system according to the present invention includes a secondary mixing device disposed between the fluid inductor apparatus and the sensor to further achieve desired homogeneity of the fluids admixed in the fluid inductor apparatus.

It is an object of the present invention to provide a flow inductor apparatus which draws fluid into a main stream of fluid.

Another object of the present invention is to provide a flow inductor apparatus which utilizes a venturi effect to draw fluid into a main stream.

Another object of the present invention is to provide a flow inductor apparatus which is capable of varying the venturi effect produced by a diamond shaped wedge placed in the main stream.

Another object of the present invention is to provide a flow inductor apparatus which incorporates a flexible member to vary the venturi effect produced in a stream.

Another object of the present invention is to provide a flow inductor apparatus which incorporates a diamond shaped wedge, the profile of which may be precisely varied.

Another object of the present invention which incorporates a venturi generating component which may be adjusted by simply rotating a knob.

Another object of the present invention is to provide a fluid inductor apparatus which incorporates a hollow deformable member to create a venturi effect in primary stream.

Another object of the present invention is to provide a fluid inductor apparatus which has minimum size and bulk.

Another object of the present invention is to provide a fluid inductor apparatus which may be used to draw a secondary fluid into a primary fluid stream in an effective manner.

Another object of the present invention is to provide a fluid inductor apparatus which utilizes a motion transmission plate with a V-shaped slot to control the profile of a diamond shaped wedge.

It is another object of the present invention is to provide a fluid inductor apparatus which utilizes a plurality of holes in a hollow wedge shaped member to induce a secondary fluid into a primary fluid stream.

It is another object of the present invention is to provide a fluid inductor which utilizes a hollow wedge to create a venturi effect in a primary stream and mechanical adjustment means to vary the profile of the hollow wedge which is inserted in the primary stream.

Another object of the present invention is to provide a fluid inductor apparatus which is capable of reliable long term operation.

Another object of the present invention is to provide a fluid inductor apparatus which is both durable and relatively economical to operate.

Another object of the present invention is to provide a fluid inductor apparatus having a relatively small number of component parts which are relatively simple to manufacture resulting in a relatively low overall cost.

It is another object of the present invention to provide a fluid inductor apparatus which is easily maintained and/or repaired in a relatively short period of time, thereby reducing the overall cost of operation.

It is another object of the present invention to provide a fluid inductor apparatus which can be installed in a relatively short period of time.

It is another object of the present invention to provide a system for sensing the mixture of the fluids at the outlet of the fluid inductor apparatus for generating a signal to a control device to adjust the geometric profile of the fluid inductor apparatus to provide a select mixture of the fluids.

It is another object of the present invention to provide a secondary mixing device disposed at the downstream end of the fluid inductor apparatus between said apparatus and the sensor to achieve further homogeneity of the fluids combined at the fluid inductor apparatus.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE PREFERRED EMBODIMENTS

Figure 1:
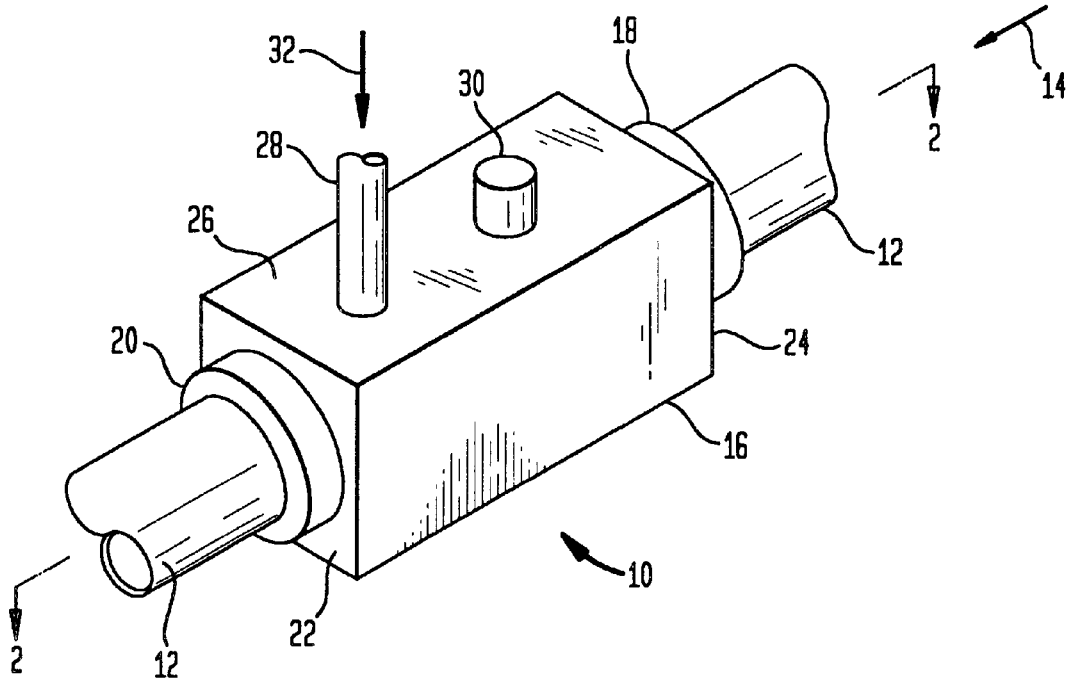
FIG. 1 is an overall perspective view of a fluid inductor apparatus according to the present invention.

In FIG. 1, a fluid inductor apparatus 10 according to the present invention is shown in a preferred embodiment inserted in a fluid conduit 12 through which there flows a fluid defined as the primary fluid. The direction of the flow of the primary fluid is shown by the arrow 14.

The apparatus 10 includes a hollow housing 16 which has fluid couplings 18,20, defined as inlet fluid coupling 18 and outlet fluid coupling 20 mounted on end panels 22,24 for interposing of the housing 16 in the fluid conduit 12. A top panel 26 of the housing 16 supports an inlet conduit 28 for a fluid defined as the secondary fluid, and an adjustment knob 30. The direction of flow of the secondary fluid is shown by arrow 32 in FIG. 1. The secondary fluid is induced to flow into the housing 16 and mix with the primary fluid in a manner which will be described below.

The top panel 26 is attached to the housing 16 in a conventional fluid tight manner.

Figure 2:
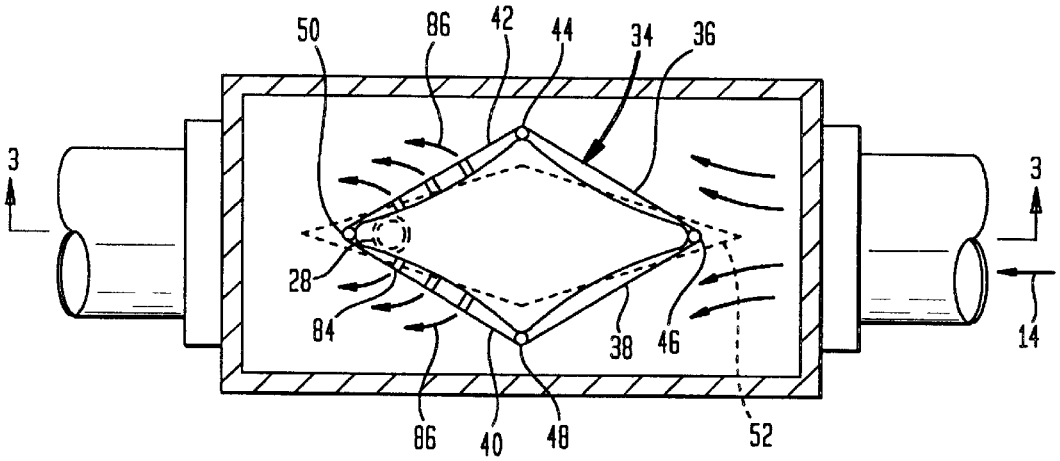
FIG. 2 is a cross-sectional view taken along the line 2—2 of FIG. 1.
Figure 3:
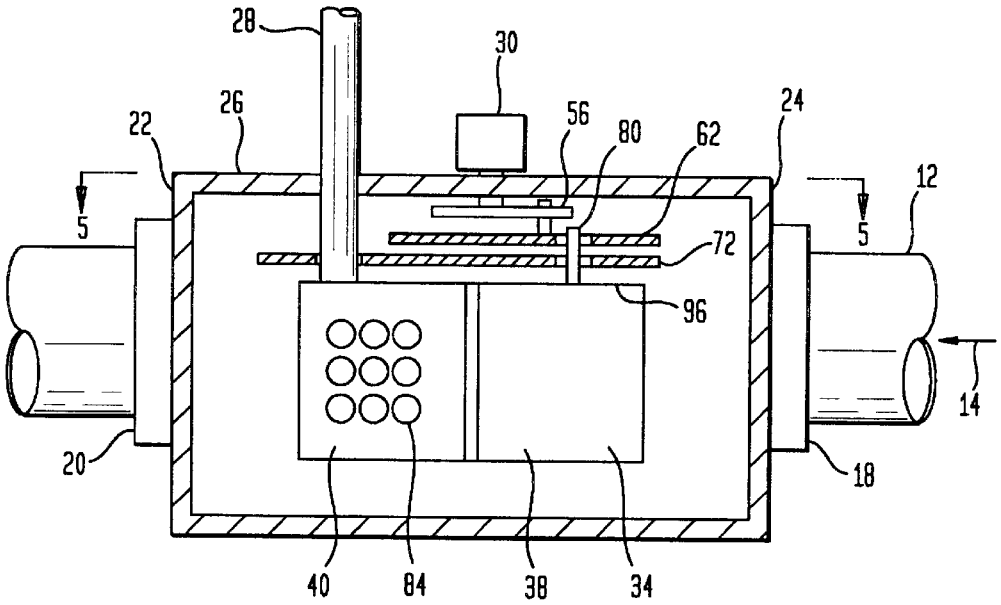
FIG. 3 is a cross-sectional view taken along the line 3—3 of FIG. 2.
Figure 4:
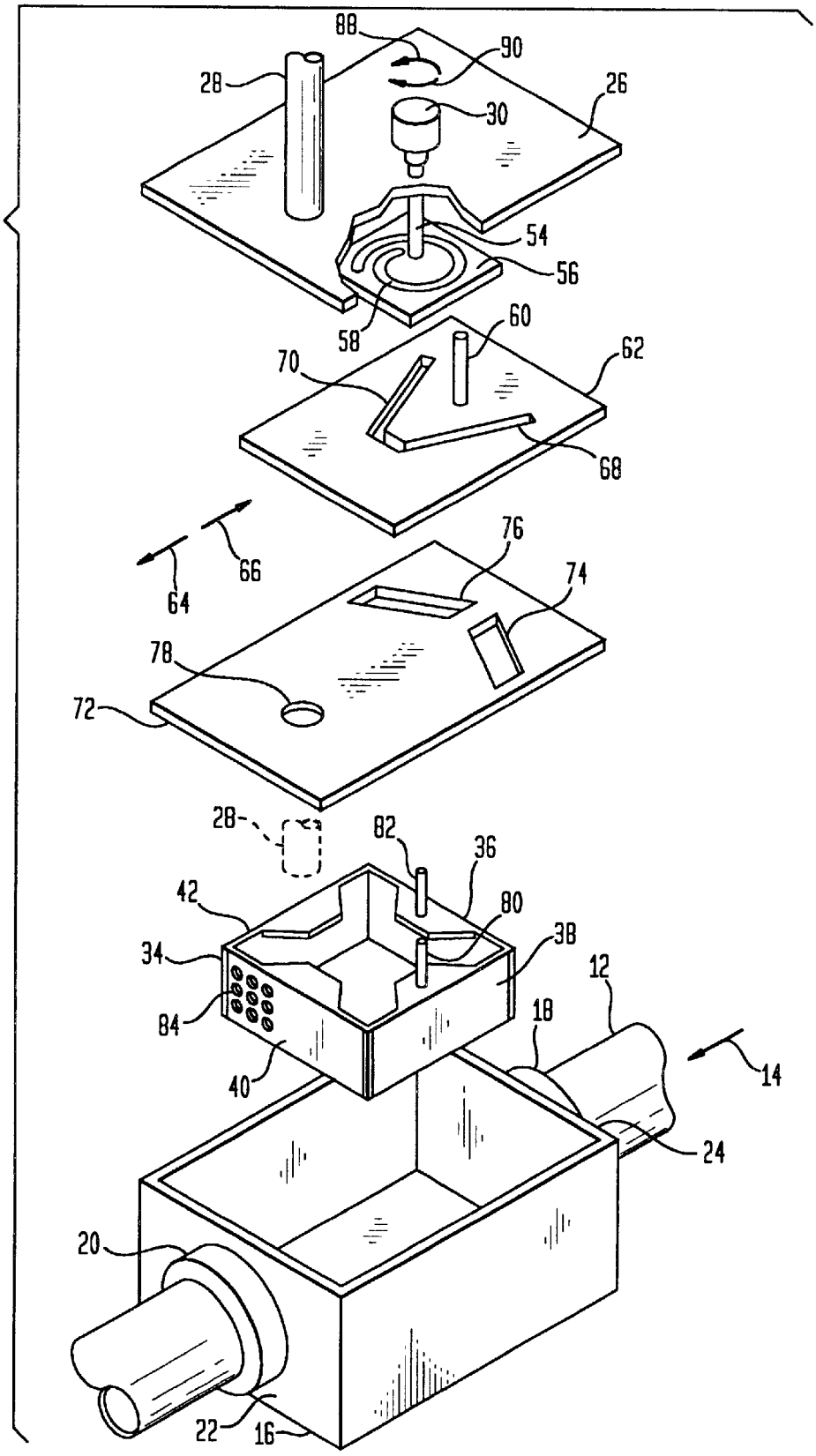
FIG. 4 is an exploded view of the apparatus of FIG. 1.

The inlet conduit 28 communicates with the secondary fluid in a hollow wedge member 34 which is disposed in the housing 16 as shown in FIGS. 2–4. The wedge member 34 has four side panels 36,38,40,42 (36–42) which are connected by hinges 44,46,48,50 (44–50) to form a diamond shaped configuration when viewed in plan view. The hinges 44–50 allow pivotal motion between adjacent panels 36–42, thereby facilitating adjustment of the dimensions of the wedge member 34 as is indicated by the broken lines 52 in FIG. 2 under the control of the adjustment knob 30.

Referring also to FIGS. 3 and 4, the adjustment knob 30 is mounted on a shaft 54 which projects through the top panel 26 into the housing 16 to a plate 56 which has a spiral groove 58. Rotation of the adjustment knob 30 causes rotation of the plate 56. A pin 60, which is mounted on a motion transmission plate 62, rides in the spiral groove 58. Rotation of the adjustment knob 30 causes motion of the motion transmission plate 62 in the direction shown by the arrow 64,66 in FIG. 4. The motion transmission plate 62 includes slots 68,70 which meet in a V-shape.

A guide plate 72 which has slots 74,76 forming a V-shape is disposed in the housing below the motion transmission plate 62. The guide plate 72 has an aperture 78 which allows passage of the inlet conduit 28 to the wedge member 34.

Oppositely disposed side panels 36,38 include guide pins 80,82 which project upwardly through the slots 74,76 in the guide plate 72 and the slots 68,70 in the motion transmission plate 62.

Rotation of the adjustment knob 30 causes rotation of the plate 56 and the expansion and contraction of the width of the wedge member 34, thereby causing a precise adjustment in the venturi effect provided by the wedge member 34 in the flow of primary fluid.

Side panels 40, 42 of the wedge member 34 include a plurality of holes 84. Secondary fluid is drawn into the wedge member 34 via the inlet conduit 28. The secondary fluid is induced to flow through the holes 84 of the side panels 40,42 and into the stream of primary fluid as indicated by the arrows 86 in FIG. 2. Rotation of the adjustment knob 30 in the directions shown by the arrows 88,90 in FIG. 4 varies the width of the deformable wedge member 34, thereby varying the strength of the venturi effect which is created by the introduction of the wedge member 34 in the stream of primary fluid which flows through the conduit 12. The venturi effect creates an area of relatively lower pressure at the rear of the panels 40,42 and control of the venturi effect effectively controls the induction or flow of secondary fluid through the conduit 28.

Figure 5A:
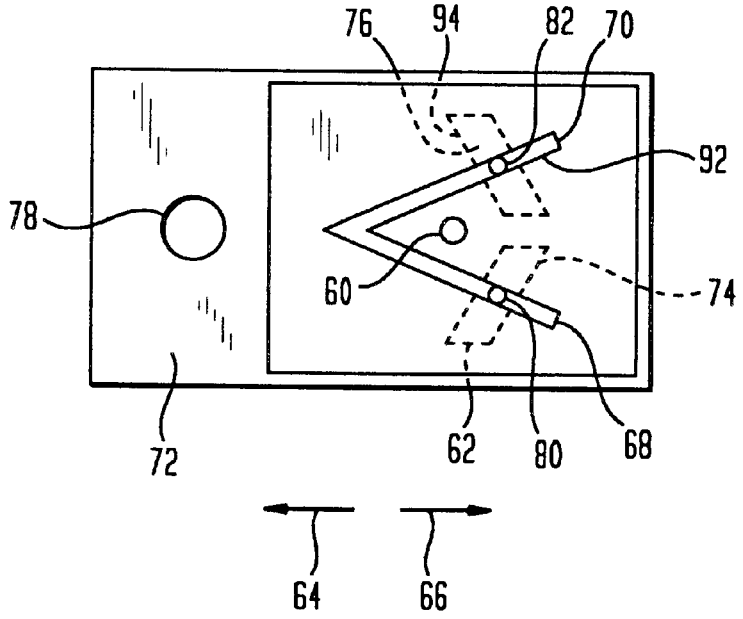
FIG. 5A is a fragmentary cross-sectional view taken along the line 5—5 of FIG. 3.

As is shown in FIGS. 4 and 5A, the slots 68,70 in the motion transmission plate 62 form a relatively wider portion 92 of the V-shape which is proximate to the inlet fluid coupling 18, while the V-shape formed by slots 74,76 has a relatively wider portion 94 which is proximate to the outlet fluid coupling 20. When the motion transmission plate 62 moves in the directions shown by the arrows 64,66 of FIGS. 4,5A, the distance between the guide pins 80,82 increases and decreases, as controlled by the adjustment knob 30, thereby changing the width of the wedge member 34. This change in width of the wedge member 34 controls the strength of the venturi effect created by the wedge member 34, and the rate of induction of the secondary fluid.

While the motion transmission plate 62 moves in the directions shown by the arrows 64,66 as described above, the guide plate 72 remains stationary covering the upper edge 96 of the wedge member 34, thereby aiding in the introduction of secondary fluid into the wedge member 34.

Figure 5B:
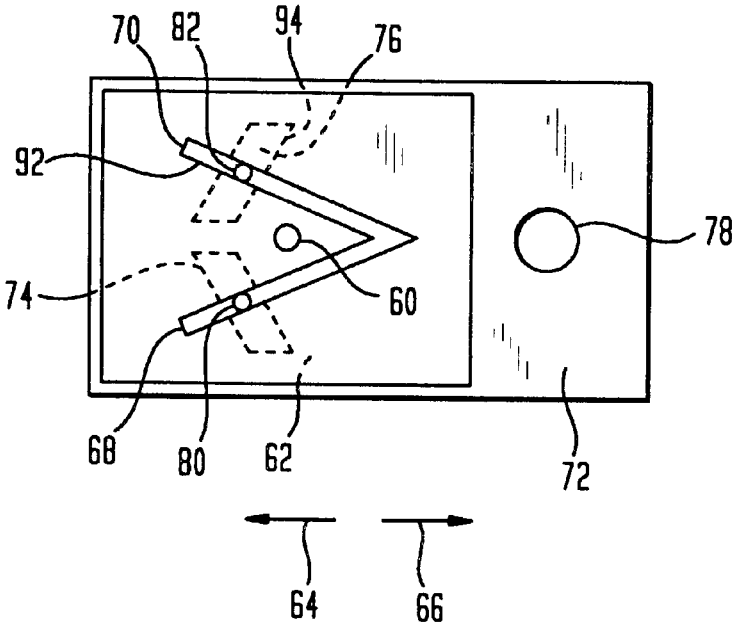
FIG. 5B is another fragmentary cross-sectional view of the fluid inductor apparatus.

Alternatively as shown in FIG. 5B, the relatively wider portion 92 of the V-shape formed by slots 68,70 may be reversed and disposed proximate to the outlet fluid coupling 20, while the wider portion 94 of the V-shape formed by slots 74,76 is disposed proximate to the inlet fluid coupling 18. Guide pins 80,82 are also now positioned on opposite side panels 40,42, and secondary inlet aperture 78 is on the side closer to inlet 18.

Figure 6:
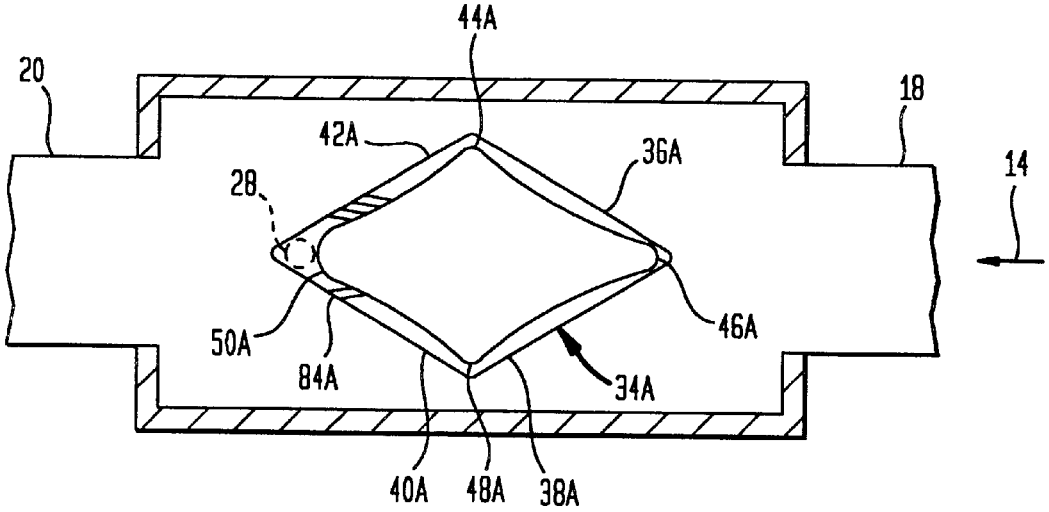
FIG. 6 is a top plan view of a portion of the apparatus shown in FIG. 4.

FIG. 6 shows another embodiment of a wedge member 34A having side panels 36A,38A,40A,42A (36A–42A) hingedly connected to form a diamond shape member. As with the wedge member embodiment 34 described above, each of the side panels 36A–42A can be constructed and arranged with respect to each other to have flexible or living hinge connections 44A,46A,48A,50A (44A–50A). With the embodiment 34A, all of the side panels 36A–42A are hollow with at least one of the side panels 40A,42A having at least one distribution passage 84A at the outlet or downstream side of the wedge member 34A. The secondary fluid is introduced into the wedge member 34A via conduit 28.

The embodiment 34A can also be constructed with only one of the side panels 40A,42A being hollow, such side panel being provided with at least one and preferably two distribution passages 84A.

The wedge members 34,34A can be of one piece construction, or constructed from the side panels 36–42 or 36A–42A which are separate and discrete panels.

The wedge members 34,34A are preferably manufactured from a plastic material.

Figure 7A:
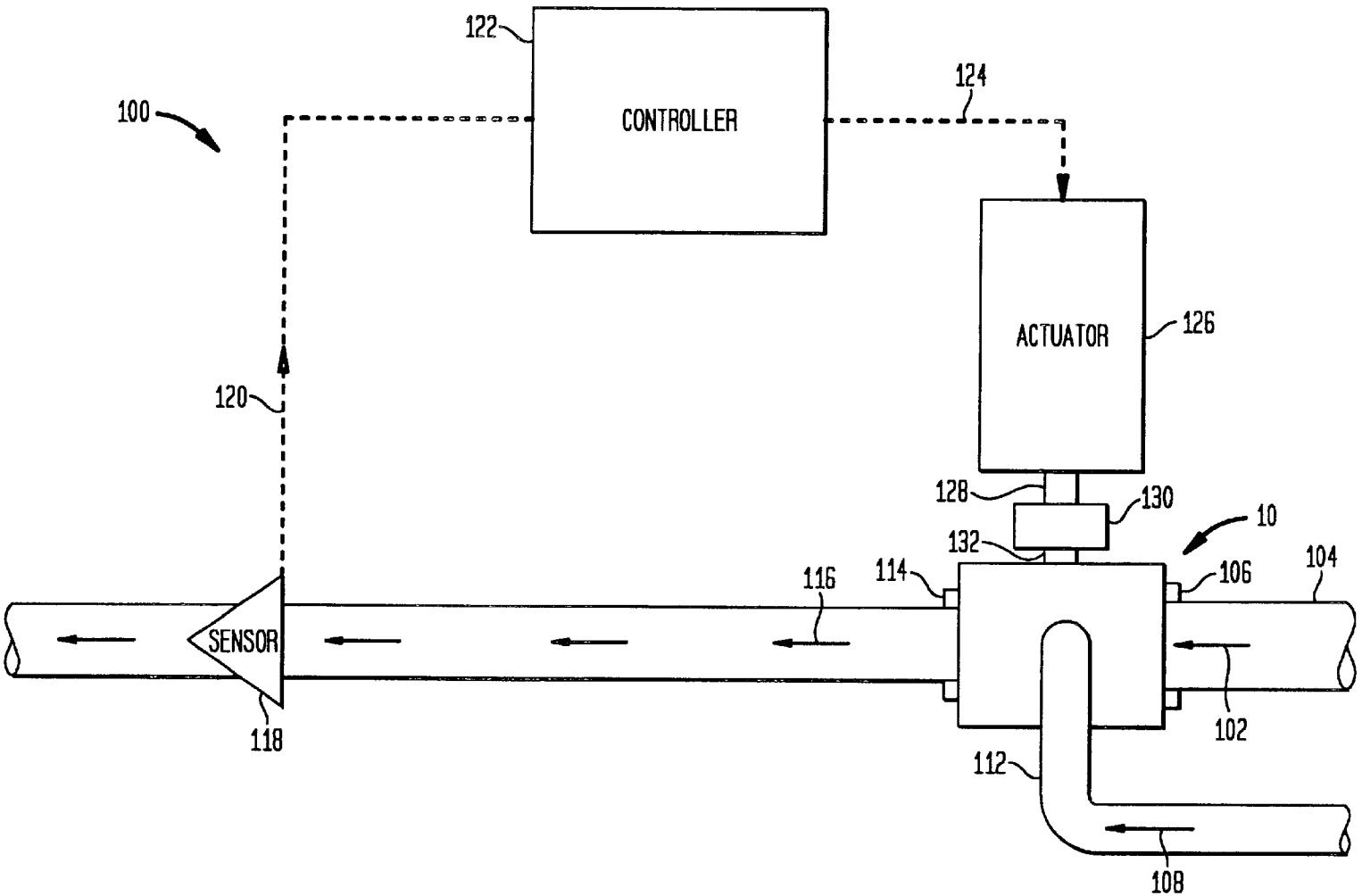
FIG. 7A is a view of a system according to the present invention having the fluid inductor apparatus.

FIG. 7A shows a system 100 according to the present invention which includes the fluid inductor apparatus 10 of the present invention. The fluid inductor apparatus 10 and its associated features operate in a manner similar to the fluid inductor apparatus discussed above, unless otherwise stated.

In the system 100, a primary fluid 102 is introduced through a pipe or conduit 104 to an inlet 106 of the fluid inductor apparatus 10. As the fluid passes through the apertures 84 of the apparatus 10, the induction process is actuated and a secondary fluid 108 is drawn into the apparatus through the pipe 112 or conduit. The fluid inductor apparatus 10 combines and mixes the fluids 102,108 in a manner discussed above with respect to the discussion of the apparatus 10 in FIGS. 1–6.

The fluids 102,108 are combined and proceed through an outlet 114 of the apparatus 10, as shown generally at 116. As the fluid 116 proceeds downstream from the apparatus 10, it passes through a sensor device 118 exposed to the fluid 116. The sensor device 118 is mounted in a downstream end of the conduit 104 to sense or measure a particular parameter, such as homogeneity, of the fluid 116. The sensor device 118 generates a signal 120 representing the fluid 116 characteristics. The signal is transmitted to and received by a controller or processor 122. The transmission signal 120 can be by hardwire or wirelessly. The controller 122 generates a signal 124 which is received by actuator mechanism 126. The signal 124 can similarly be transmitted by hardwire or wirelessly.

The mechanism 126 is adapted to mechanically adjust the dimensions or geometric profile of the apparatus 10 to mix the fluids 102,108 in the manner desired and selected. That is, the rate of mixing the primary and secondary fluids 102,108 can be selectively controlled. The system 100 is able to continuously sense the fluid 116 to determine if it is within acceptable parameters and if not, adjust the dimensions of the hollow wedge member 34 (FIG. 3) of the apparatus 10 to induce the secondary fluid into the primary fluid at a rate within the desired parameters to provide the preferred fluid composition 116.

The mechanism 126 is connected to the apparatus 10 by means of a connecting member 128 and 130, such as a transmission assembly. This structure 128,130 is used in addition to or in lieu of the adjustment knob 30 (FIGS. 1,3) of the apparatus 10. A seal or gland 132, provides a water tight connection between the transmission assembly and the apparatus 10.

Figure 7B:
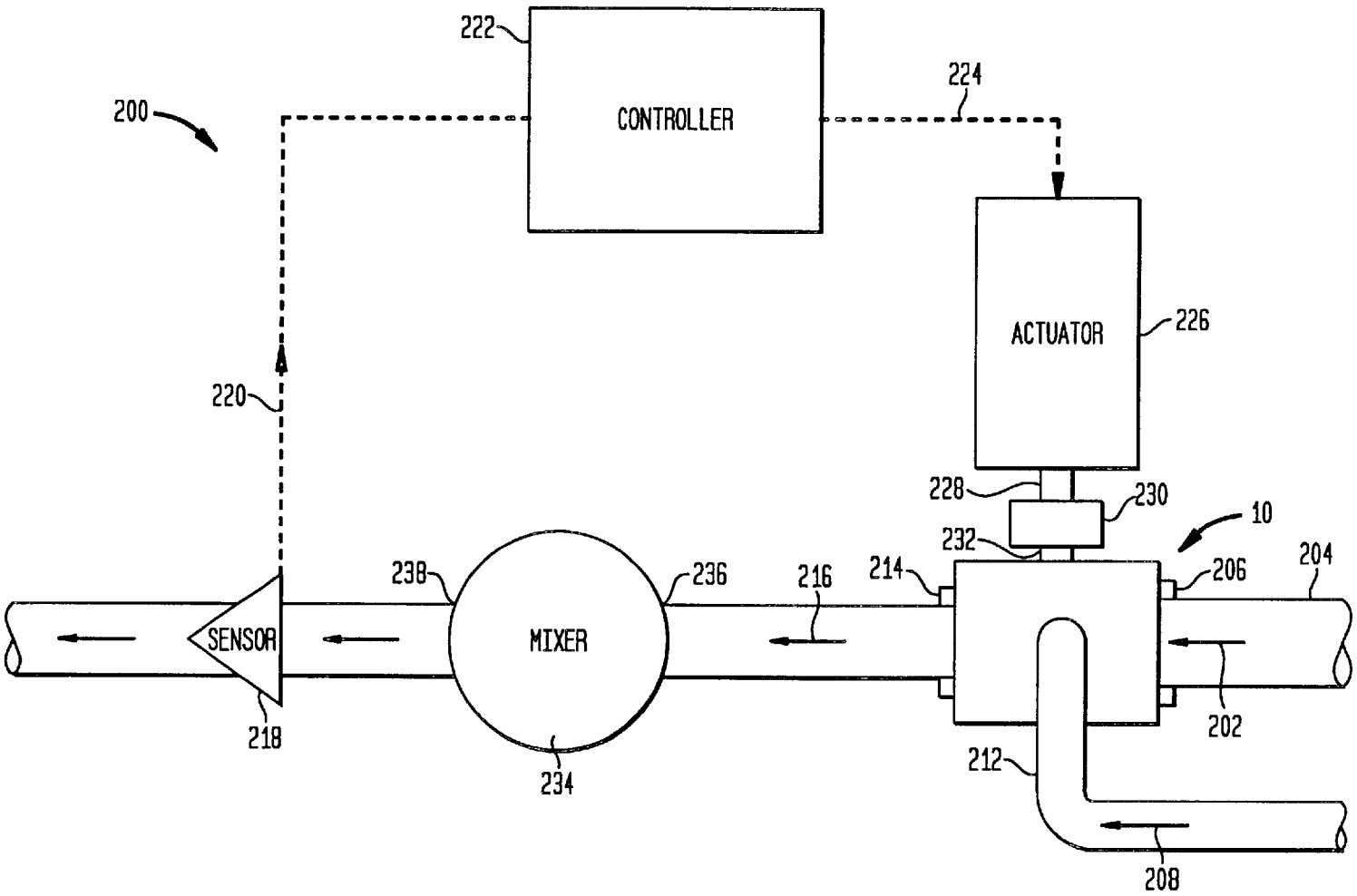
FIG. 7B is a view of another embodiment of a system according to the present invention having the fluid inductor apparatus.

FIG. 7B shows another embodiment of a system 200 according to the present invention which includes the fluid inductor apparatus 10. The fluid inductor apparatus 10 and its associated features operate in a manner similar to the fluid inductor apparatus discussed above, unless otherwise stated.

In the system 200, a primary fluid 202 is introduced through a pipe or conduit 204 to an inlet 206 of the fluid inductor apparatus 10. As the fluid passes through the apparatus 10, the induction process is actuated and a secondary fluid 208 is drawn into the apparatus through the pipe 212 or conduit. The fluid inductor apparatus 10 combines and mixes the fluids 202,208 in a manner discussed above with respect to the discussion of the apparatus 10 in FIGS. 1–6.

The fluids 202,208 are combined and proceed through an outlet 214 of the apparatus 10, as shown generally at 216. As the fluid 216 proceeds downstream from the apparatus 10, it passes through a sensor device 218 exposed to the fluid 216. The sensor device 218 is mounted in a downstream end of the conduit 204 to sense or measure a particular parameter, such as homogeneity, of the fluid 216. The sensor device 218 generates a signal 220 representing the fluid 216 characteristics sensed, which signal is transmitted to and received by a controller or processor 222. The transmission can be by hardwire or wirelessly. The controller generates a signal 224 which is received by actuator mechanism 226. The signal 224 can similarly be transmitted by hardwire or wirelessly.

The mechanism 226 is adapted to function similar to the mechanism 126 of FIG. 7A, and to coact with the hollow wedge member 34 of the apparatus 10 to mix the fluids 202,208 in the manner desired and selected. A seal or gland 232 provides a water tight connection between the transmission assembly and the apparatus 10.

The system 200 shown in FIG. 7B includes a secondary mixer device 234 disposed between the apparatus 10 and the sensor means 218. The secondary mixer device is in communication with the fluid 216 at the downstream end of the conduit 204 to further achieve homogeneity of the primary and secondary fluids 202,208 combined in the fluid inductor apparatus 10. The secondary mixer 234 employs for example, mechanical means or ultrasound to further mix the fluid 216 to provide the desired uniformity within the fluid 216. The fluid 216 enters an inlet 236 of the secondary mixing device 234 to be further mixed or acted upon, and then exits an outlet 238 of the device 234 to thereby contact the sensor device 218 in a mixture that will require only a minor amount of adjustment, if any at all, by the control assembly 222 and actuator 226. By having the fluid 216 in a mixture with the parameters as close as possible to those required, there are then only minor adjustments needed of the geometric profile of the apparatus 10 to induce the secondary fluid into the primary fluid.

The induction rate of the secondary fluid 108,208 can be adjusted as necessary to achieve a resulting fluid composition 116,216.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A fluid inductor system comprising:

a housing comprising:

a first inlet for a first fluid flow, a second inlet for a second fluid flow, a downstream outlet for an outlet flow;

fluid inductor means disposed in said housing in communication with said first and second inlets and said downstream outlet, said fluid inductor means activable to induce said second fluid into said first fluid to provide a select fluid composition;

sensor means in communication with said outlet flow for sensing fluid composition of said outlet flow and generating a signal representing said fluid composition; and control means in communication with said sensor means and said fluid inductor means for receiving said signal and controlling actuation of said fluid inductor means to provide said fluid composition.

2. The system according to claim 1, further comprising:

mixing means in communication with said outlet flow between said downstream outlet and said sensor means for mixing said outlet flow for being sensed by said sensing means.

3. The system according to claim 2, wherein the mixing means is selected from the group consisting of mechanical mixers and ultrasound mixers.

4. The system according to claim 1, wherein said fluid inductor means comprises a hollow wedge shaped member.

5. The system according to claim 1, further comprising:

transmission means interconnecting said control means and said fluid inductor means for activating said fluid inductor means.

6. The system according to claim 1, wherein said fluid inductor means comprises:

an adjustable hollow member disposed in said housing between said first inlet, said second inlet and said downstream outlet, and having a plurality of holes formed in said adjustable hollow member proximate to said downstream outlet.

7. A fluid inductor system comprising:

a housing comprising:

primary fluid inlet means;

primary fluid outlet means;

secondary fluid inlet means;

hollow inductor means disposed in said housing between said primary fluid inlet means, primary fluid outlet means and secondary fluid inlet means, said hollow inductor means having a plurality of holes formed therein proximate to said primary fluid outlet means;

sensor means exposed to said primary fluid outlet means for sensing fluid at said primary fluid outlet means and generating a signal representing said outlet fluid; and control means in communication with said sensor means and said hollow inductor means, said control means adapted to receive said sensor signal and generate a control signal to control the shape of said hollow inductor means to induce secondary fluid to flow into said primary fluid at said hollow inductor means.

8. A method of controlling introduction of one liquid into another liquid, the method comprising the steps of:

moving a first fluid stream through a flow path;

interposing a hollow distribution member in said flow path to provide a venturi effect creating a low pressure area on a downstream side of the distribution member;

adjusting the shape of the distribution member in the flow path to effect the low pressure region in the flow path downstream of the distribution member;

introducing a second fluid into the distribution member;

inducing said second fluid through at least one passage in the distribution member to the downstream side of the distribution member by the low pressure created from the venturi effect;

sensing a downstream fluid exiting the distribution member;

generating a signal representing said downstream fluid; and monitoring said signal for determining adjustment of said distribution member.

9. The method according to claim 8, further comprising the step of:

mixing the downstream fluid after said step of inducing said second fluid.

* * * * *